US005442932A

United States Patent [19]

O'Hearne

[11] Patent Number: 5,442,932

[45] Date of Patent: Aug. 22, 1995

[54] OPEN TOPPED, AIR CURTAIN CLOSED COOLER CHEST

[75] Inventor: Robert L. O'Hearne, St. Louis, Mo.

[73] Assignee: Seco Products Corporation, Washington, Mo.

[21] Appl. No.: 305,404

[22] Filed: Sep. 13, 1994

Related U.S. Application Data

[63] Continuation of Ser. No. 80,561, Jun. 21, 1993, abandoned.

[51] Int. Cl.[6] ..... A47F 3/04

[52] U.S. Cl. ..... 62/255; 62/418

[58] Field of Search ..... 62/255, 256, 405, 413, 62/418

[56] References Cited

U.S. PATENT DOCUMENTS

| | | | |
|---|---|---|---|
| 1,907,680 | 5/1933 | Strass | 62/255 |
| 2,463,104 | 3/1949 | Hender | 62/255 |
| 2,732,689 | 1/1956 | Shreve | 62/255 X |
| 2,915,884 | 12/1959 | Haushalter et al. | 62/256 |
| 2,938,363 | 5/1960 | Dickinson et al. | 62/249 |
| 3,491,548 | 1/1970 | Christiansen | 62/255 |
| 4,019,339 | 4/1977 | Anderson | 62/255 |
| 4,840,040 | 6/1989 | Fung | 62/255 |
| 4,916,917 | 4/1990 | Jackson, Jr. | 62/256 X |

*Primary Examiner*—William E. Tapolcai
*Attorney, Agent, or Firm*—Laff, Whitesel, Conte & Saret, Ltd.

[57] ABSTRACT

A cooler chest has an open top which may be covered or uncovered by removable doors. A plurality of downwardly directed jets around the upper periphery of the chest forces cold air into the bottom of the chest, thereby displacing warm air from the chest and into the ambient atmosphere. The cold air in the chest is drawn through an evaporator coil for further cooling and then returned to the jets at the upper periphery for a continued cooling of the chest.

15 Claims, 3 Drawing Sheets

OPEN TOPPED, AIR CURTAIN CLOSED COOLER CHEST

This application is a continuation of application Ser. No. 08/080,561, filed Jun. 21, 1993, now abandoned.

This invention relates to refrigeration equipment, and more particularly to refrigerator equipment, coolers, cooling chests, and the like, which can maintain a volume of cooled air at 40° F. or less with the doors removed from the top of the chest.

The invention may find use in connection with almost any refrigeration equipment. However, for convenience of expression, the term "cooling chest" will be used hereinafter to cover all suitable equipment.

There are many times when and places where it is desirable to have refrigeration equipment, such as cooling chests, which maintain a desired low temperature (40° F. or less) without requiring doors on the chest. An example of such equipment might be found in a grocery store where boxes, beverages, or the like are on display in cooling chests with open tops. The customer only has to reach into the cooling chest and take a selected item, without having to open any doors to do so.

Most refrigeration units or cooling chests of this type have a horizontal cross flow of air forming an air curtain at the top of the chest. The cold air curtain is formed by jets blowing the cold air with sufficient force to effectively close off the top of the chest in order to block entry of outside ambient air. Jets having this velocity create eddy currents which tend to draw in ambient air and which interfere with the cold air current effect. Also, the eddy currents tend to draw off the cooled air within the cooling chest and to dissipate it into the warm ambient air. The now warmed air which remains in the air curtain jet is returned to the refrigerator or cooling chest where it is recooled and recycled, thus reducing the efficiency of the refrigeration unit.

Accordingly, an object of the invention is to provide new and improved means for and methods of retaining cooled air inside a doorless cooling chest having a top opening. Here, an object is to provide a cold air curtain which maintains a normal air flow so as to create a minimum amount of eddy currents.

In keeping with an aspect of the invention, these and other objects are accomplished by feeding cooled air in downwardly directed jets from an upper perimeter of the chest. The invention provides any convenient plenum for conveying the cooled air from the bottom of the chest back to the downwardly directed jets at the top perimeter of the chest. Preferably, the plenum is formed between some or all of a space between a liner and an outer insulated casing of the cooling chest.

Thus, the cooled air enters the chest via a number of holes at the top perimeter of the liner and there is directed downwardly into the chest with a flow pattern which is normal because such cooled air is denser than the warm ambient air within the chest. The cooled air fills the chest, displacing the warm air therein. Any warm air remaining within the chest is drawn into an evaporator where it loses its absorbed heat and then is redirected into the cooled air stream.

Preferred embodiments of the invention are shown in the attached drawings, in which.

Figure 1:
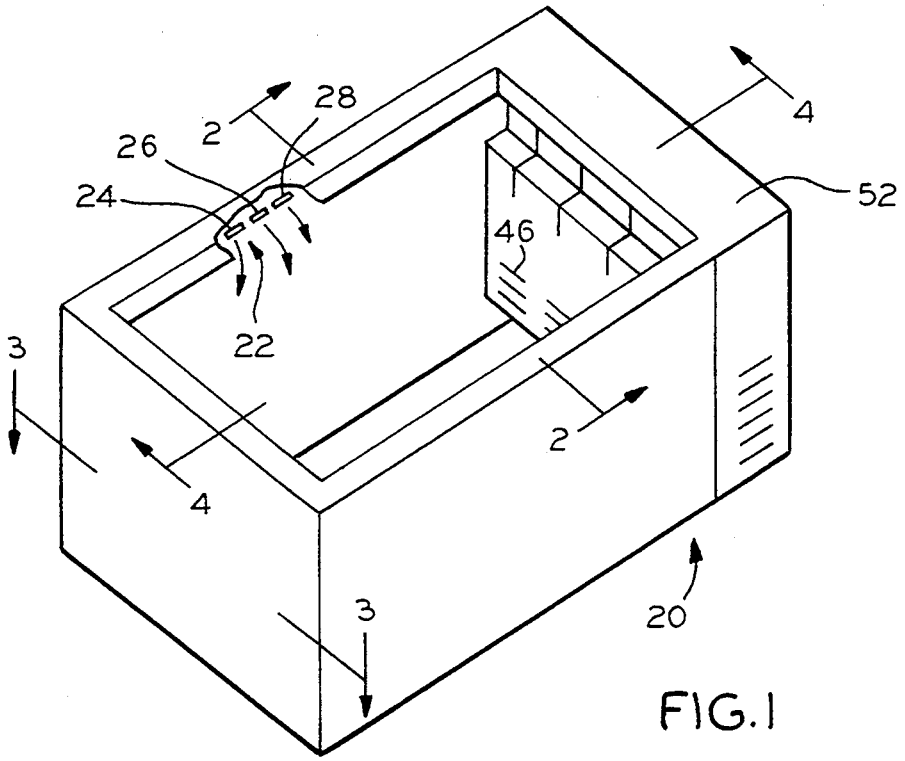
FIG. 1 is a perspective view of the inventive cooling chest.

FIG. 1 shows a cooling chest 20 with a small portion of the upper frame cut away at 22 to reveal a few of the air curtain outlet ports 24, 26, 28 which surround the entire upper perimeter of the cooling chest. A deflector in the form of skirt 29 (FIGS. 2, 4) on the upper frame 30 surrounds the opening 32 (FIG. 2) in the top of the cooling chest and also provides a ledge 34 on which removable doors 36, 38 (FIG. 4) may or may not set. Skirt 29 forms a deflector means for directing air from the air ports 24, 26, 28 in downward jet streams.

Figure 2:
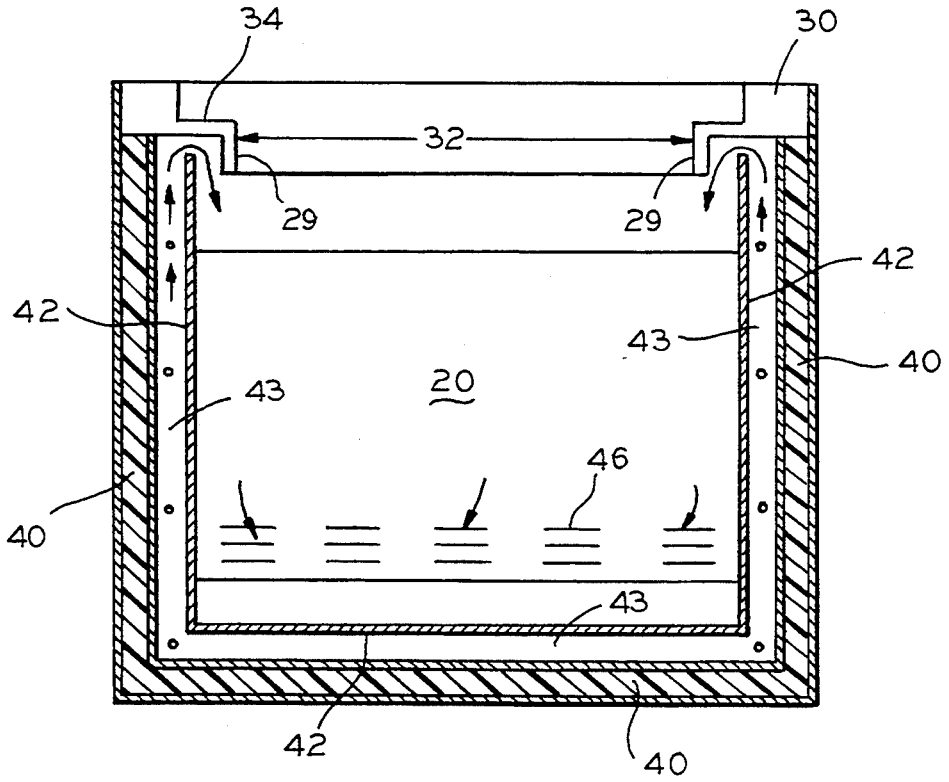
FIG. 2 is a cross-section taken along line 2—2 of FIG. 1, showing the air flow in plane 2—2.
Figure 3:
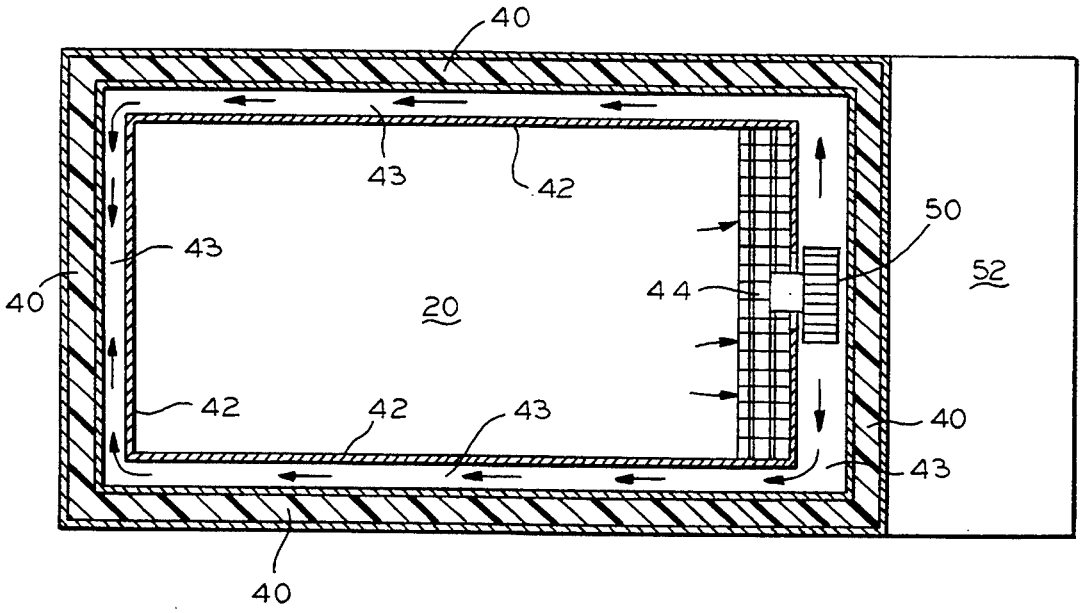
FIG. 3 is a cross-section taken along line 3—3 of FIG. 1, showing an evaporator coil and a blower, along with the cooled air flow pattern in plane 3—3.
Figure 4:
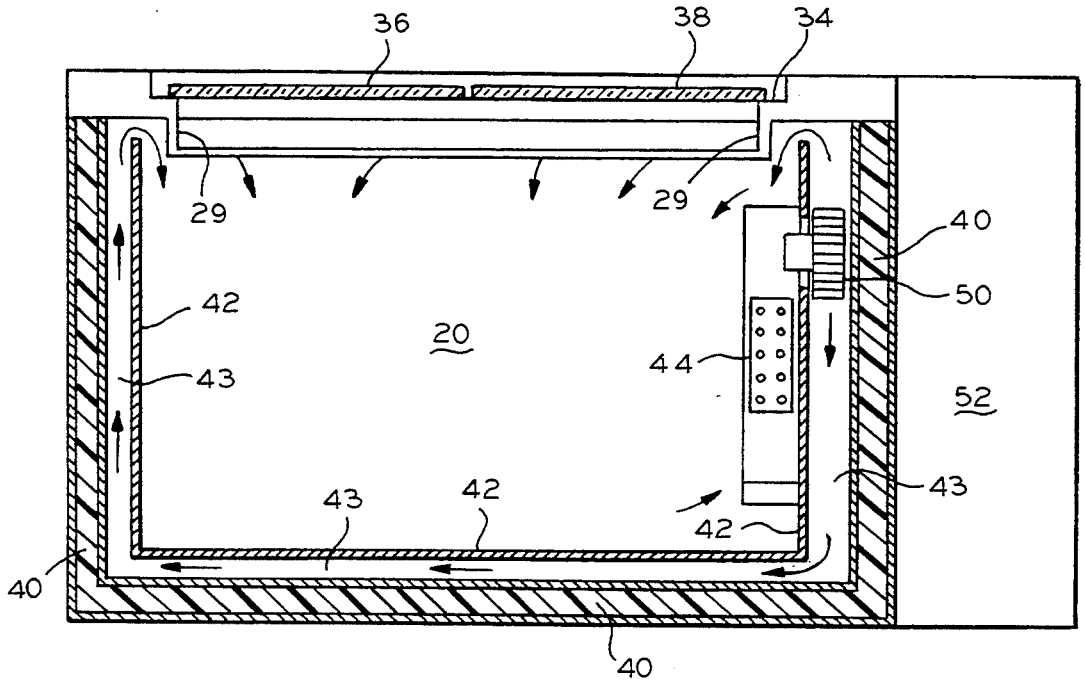
FIG. 4 is a cross-section taken along line 4—4 with the removable doors in place closing the top of the chest, and showing the cooling air flow pattern in plane 4—4.

The cooling chest 20 has an outside wall insulated on three sides, as shown at 40 (FIGS. 2–4). Inside the insulated wall is a chest liner 42 which is spaced far enough away from the insulated sides to provide a plenum space 43 for a cooled air flow. The chest 20 and liner 42 may be made of any suitable material.

In one end of the cooler chest is an evaporation coil 44 (FIGS. 3, 4) which cools the return air that enters louvers 46 (FIG. 2) in a lower region of the cooling chest. A blower 50 is behind the evaporator coils 44 and in a region communicating with the plenum space 43 between the liner 42 and insulated wall 40. The blower 50 forces air to circulate in the cold air flow pattern shown by the arrows in the various Figures.

Outside the insulated walls 40 and in the space 52, a conventional compressor-electric motor combination supplies a coolant to evaporating coils 44 which provides the cooling that is required to bring the air into the desired temperature range. While any suitable temperature may be maintained, a temperature of 40° F. or less was provided in one embodiment.

In operation, the blower wheel 50 draws air through louvers 46, the evaporator coil 44, and into a plenum 43 formed in the space between the insulated wall 40 and the inside liner 42. The cooled air enters the refrigerated compartments from the row of air ports 24, 26, 28 (FIG. 1) beneath frame 30 at the top of the chest. The skirt or deflector 29 of frame 30 directs the cooled air in downwardly directed air jets along all four vertical walls 40 of the cooler chest. The downwardly directed air jets causes a natural flow pattern since colder air is denser and tends to sink through warmer air. As the supply of cooled air fills the cooler chest, it replaces the warmer air displacing most of it upwardly into the ambient atmosphere. The air in the chest returns via louvers 46 to the evaporator coils 44 and onto the plenum 43, which maintains the cool temperature.

The jets of cooled air exiting ports 24, 26, 28 are directed downwardly by deflector 29 so that if any eddy currents appear, they are contained within the cooler chest. If these eddy currents draw air from outside the chest, it joins the cooled air within the chest and eventually contributes to the overall cooling. Since the cooled air is denser, it will naturally tend to stay in the bottom of the cooling chest and prevent entry of warm ambient air into the chest.

This is distinguished from the prior art where horizontal jets cause eddy currents which tend to direct cooled air out of the chest and into the ambient atmosphere. Thus, the inventive system with downwardly directed jets of air is much more efficient than the older air curtains formed by horizontal jets.

An important feature is supplying cooled air around the perimeter of a top opening and in a downward direction. Therefore, the invention and the appended claims are intended to cover all suitable means for accomplishing this feature.

Figure 5:
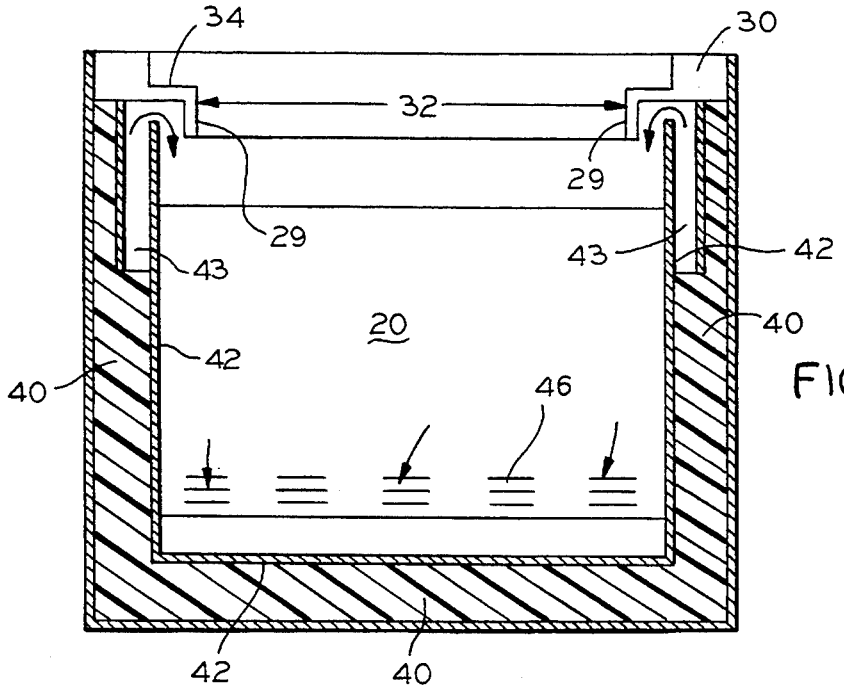
FIG. 5 is similar to FIG. 2 and shows a second embodiment of the invention with the plenum limited to an upper portion of the chest.
Figure 6:
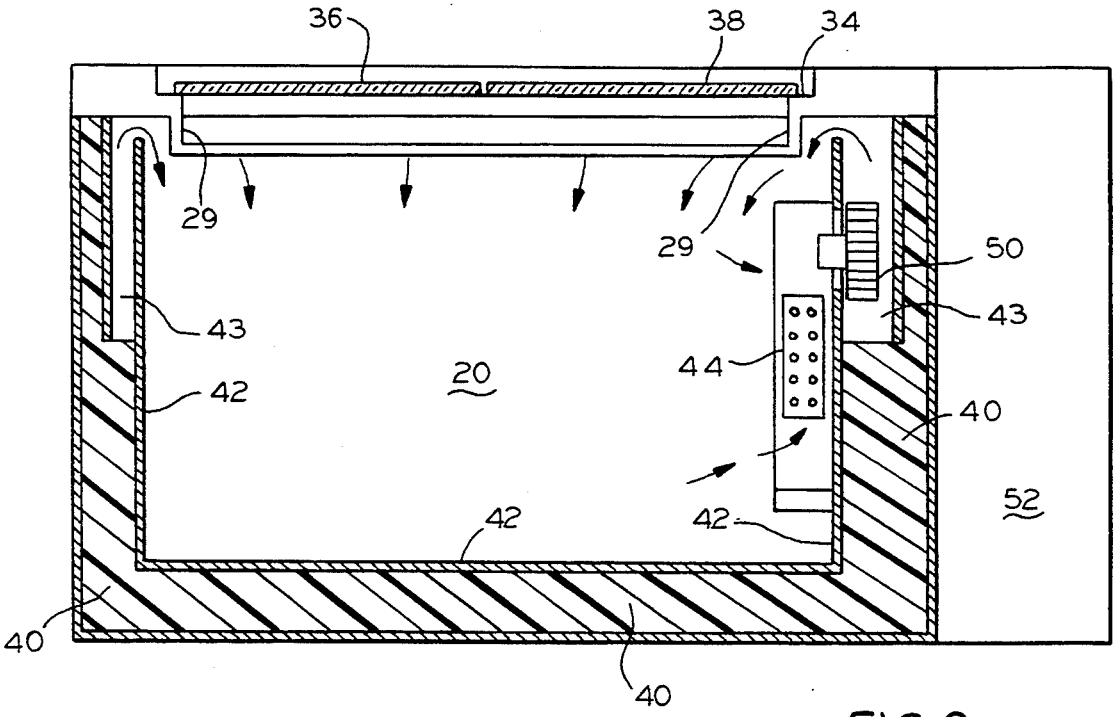
FIG. 6 is similar to FIG. 4 and shows the second embodiment, which is also shown in FIG. 5.

For example, in a second embodiment (FIGS. 5, 6), the plenum 43 is restricted to an upper portion of the chest with the lower portion of the chest walls fully insulated across the entire width thereof. Needless to say, this plenum is also of a shape which includes the louvers 46, blower 50, and evaporator coils 44.

Figure 7:
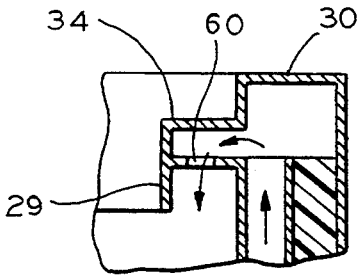
FIG. 7 shows a fragment of FIGS. 2 or 5 where the plenum is in the door frame at the top of the chest.

In still another embodiment (FIG. 7), the plenum at the top of the chest may be enclosed almost entirely within the frame 30 which is hollow, with the downwardly directed air ports 60 formed beneath the door seat 34 and behind the skirt 29. Other plenum configurations will readily occur to those who are skilled in the art.

Those who are skilled in the art will readily perceive how to modify the invention. Therefore, the appended claims are to be construed to cover all equivalent structures which fall within the true scope and spirit of the invention.

The claimed invention is:

1. A cooling chest having a top area which may be open to ambient air, said chest comprising an insulated wall forming four sides and a bottom of a refrigerated compartment, means for cooling and pressurizing air within a plenum surrounding an upper periphery of said chest, a row of air ports surrounding the inside periphery of and near the top of said chest for giving exit to said pressurized air, deflector means associated with and in front of said air ports for directing said cooled pressurized air from said plenum downwardly along the side walls of said chest, said deflector comprising a vertical skirt for forcible directing air in said downwardly direction along said sidewalls of said chest, and means near the bottom of said chest for returning air from said refrigerated compartment in said chest to said means for cooling and pressurizing said air.

2. The chest of claim 1 wherein said plenum is formed by a liner spaced away from an inside surface of said insulated wall.

3. The chest of claim 2 wherein said plenum surrounds an entire surface area of said insulated wall.

4. The chest of claim 2 wherein said plenum surrounds an upper portion of an inside surface of said insulated wall.

5. The chest of claim 1 wherein a top surface of said chest has a frame on which doors may rest, said frame being substantially hollow to form at least part of said plenum.

6. The chest of claim 1 wherein said means for cooling and pressurizing said air comprises an evaporating coil in the path of said returning air, and a blower for drawing said returning air through said evaporator coil and blowing it out the air ports.

7. The chest of claim 1 wherein said deflector means comprises a frame surrounding an opening forming the top of said chest, said frame having a skirt which surrounds the air ports to form downwardly directed jets, and said frame further providing means for supporting removable doors that may close the top of said chest.

8. The chest of claim 7 wherein said frame is hollow and forms at least part of said plenum.

9. The chest of claim 1 and compressor means in said chest and outside said insulated walls for supplying coolant to said evaporating coils.

10. A refrigerator unit comprising a chest with insulated walls having removable doors on its top surface, air entrance ports surrounding an upper periphery of said chest, air exit ports in a lower area of said chest, a plenum interconnecting said entrance and exit ports, means for cooling and pressurizing air in said plenum so that air flows in a pattern from said entrance port through said chest to said exit ports and returns to said entrance ports, said air flow pattern being a pattern which naturally occurs as a result of the density of cooled air inside said chest, and deflector means associated with said entrance port for directing said air flow pattern from said entrance ports into downwardly directed jets within said chest.

11. The unit of claim 10 wherein said top surface of said chest is a frame having a skirt dependent therefrom, said frame receiving and supporting said removable doors, and said dependent skirt being positioned in front of said entrance ports at the upper periphery of said chest to direct jets of air down the walls of said chest.

12. The unit of claim 10 wherein said plenum is a space between said insulated walls of said chest and a liner adjacent said walls and containing said entrance and exit ports.

13. The unit of claim 10 wherein said chest has a hollow frame at its top to support said removable doors, said hollow frame forming at least a part of said plenum.

14. The unit of claim 10 wherein said cooling and pressurizing means comprises an evaporating coil position to receive air passing through said exit ports, and a blower positioned in said plenum to blow air out said entrance port and to suck air from said exit ports and through said evaporator coil.

15. The unit of claim 14 and means in said chest but outside said insulated walls to supply coolant to said evaporator coils and to operate said blower.

* * * * *